US010360843B2

(12) United States Patent
Chen

(10) Patent No.: US 10,360,843 B2
(45) Date of Patent: Jul. 23, 2019

(54) OLED PWM PIXEL DRIVING METHOD

(71) Applicant: Shenzhen China Star Optoelectronics Technology Co., Ltd., Shenzhen (CN)

(72) Inventor: Mingfeng Chen, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/328,516

(22) PCT Filed: Jan. 9, 2017

(86) PCT No.: PCT/CN2017/070642

§ 371 (c)(1),
(2) Date: Jun. 7, 2017

(87) PCT Pub. No.: WO2018/036087

PCT Pub. Date: Mar. 1, 2018

(65) Prior Publication Data

US 2018/0190186 A1 Jul. 5, 2018

(30) Foreign Application Priority Data

Aug. 25, 2016 (CN) ..... 2016 1 0717139

(51) Int. Cl.
*G09G 3/3208* (2016.01)
*G09G 3/20* (2006.01)
(Continued)

(52) U.S. Cl.
CPC ..... *G09G 3/3208* (2013.01); *G09G 3/2033* (2013.01); *G09G 3/3233* (2013.01);
(Continued)

(58) Field of Classification Search
CPC .. G09G 3/3208; G09G 2320/029; G09G 3/36; G09G 3/32; G09G 5/10
See application file for complete search history.

(56) References Cited

U.S. PATENT DOCUMENTS 5,986,640 A * 11/1999 Baldwin ..... G09G 3/2033 345/596
7,015,878 B1 * 3/2006 Doyen ..... G09G 3/2029 315/169.3
(Continued)

FOREIGN PATENT DOCUMENTS

CN 1545688 A 11/2004
CN 1720565 A 1/2006
(Continued)

OTHER PUBLICATIONS

International Search Report and Written Opinion issued in related PCT/CN2017/070642 dated Mar. 30, 2017.
(Continued)

*Primary Examiner* — Christopher E Leiby
(74) *Attorney, Agent, or Firm* — Andrew C. Cheng

(57) ABSTRACT

Disclosed is an OLED PWM pixel driving method. The method comprises: slicing a frame of image into a plurality of subfields different in weight, and splitting a subfield having a higher weight thereamong into secondary subfields in a predetermined splitting ratio; and rearranging the split secondary subfields from the subfield having a higher weight and non-split subfields according to an input image and the predetermined splitting ratio in order to eliminate an image display error.

2 Claims, 3 Drawing Sheets

(51) Int. Cl.
*G09G 3/3233* (2016.01)
*G09G 3/3275* (2016.01)

(52) U.S. Cl.
CPC ..... *G09G 3/3275* (2013.01); *G09G 2320/029* (2013.01); *G09G 2320/0266* (2013.01)

(56) References Cited

U.S. PATENT DOCUMENTS

| | | | | |
|---|---|---|---|---|
| 2004/0233135 | A1* | 11/2004 | Kim | G09G 3/2944 345/63 |
| 2007/0171241 | A1* | 7/2007 | Kimura | G09G 3/2029 345/690 |

FOREIGN PATENT DOCUMENTS

| | | | |
|---|---|---|---|
| CN | 101140728 | A | 3/2008 |
| CN | 101154344 | A | 4/2008 |
| CN | 101625829 | A | 1/2010 |
| CN | 202058415 | U | 11/2011 |
| CN | 102968948 | A | 3/2013 |
| CN | 104751795 | A | 7/2015 |
| CN | 105047139 | A | 11/2015 |
| CN | 106097966 | A | 11/2016 |
| EP | 1 921 597 | A2 | 5/2008 |
| JP | 2002351431 | A | 12/2002 |

OTHER PUBLICATIONS

Machine translation of CN101140728A by Lexis Nexis Total Patent on Apr. 30, 2018.
Machine translation of CN101154344A by Lexis Nexis Total Patent on Apr. 30, 2018.
Machine translation of CN101625829A by Lexis Nexis Total Patent on Apr. 30, 2018.
Machine translation of CN102968948A by Lexis Nexis Total Patent on Apr. 30, 2018.
Machine translation of CN104751795A by Lexis Nexis Total Patent on Apr. 30, 2018.
Machine translation of CN105047139A by Lexis Nexis Total Patent on Apr. 30, 2018.
Machine translation of CN1545688A by Lexis Nexis Total Patent on Apr. 30, 2018.
Machine translation of CN1720565A by Lexis Nexis Total Patent on Apr. 30, 2018.
Machine translation of CN202058415U by Lexis Nexis Total Patent on Apr. 30, 2018.
Machine translation of CN106097966A by Lexis Nexis Total Patent on Apr. 30, 2018.
Machine translation of JP2002351431A by Lexis Nexis Total Patent on Apr. 30, 2018.

* cited by examiner

OLED PWM PIXEL DRIVING METHOD

CROSS-REFERENCE TO RELATED APPLICATIONS

The present application claims the priority of Chinese patent application CN 201610717139.7, entitled "OLED PWM pixel driving method" and filed on Aug. 25, 2015, which is incorporated herein by reference in its entirety.

FIELD OF THE INVENTION

The present disclosure belongs to the technical field of organic display control, and specifically, the present disclosure particularly relates to an OLED PWM pixel driving method.

BACKGROUND OF THE INVENTION

As shown in FIG. 1, an existing 3T1C (3 transistors T1, T2, T3, and 1 capacitor Cst) pixel driving circuit for an Organic Light Emitting Diode (OLED) is illustrated, wherein D is a data driving signal; G is a charging scanning signal; DG is a discharging scanning signal; ODdd is a constant voltage signal; Ovss is an active OLED output voltage; and Vref is a reference voltage. When the circuit operates for digital driving, only two Gamma voltage levels, i.e., both GM1 (brightest) and GM9 (darkest) voltage levels, are output at $V_A$. A transistor current-voltage (I-V) equation is expressed by:

$$I_{ds,sat}=k\cdot(V_{GS}-V_{th,T2})^2=k\cdot(V_A-V_S-V_{th,T2})^2,$$

wherein $I_{ds,sat}$ is a transistor activation current; k is an intrinsic conduction factor; $V_{GS}$ is a transistor gate-source voltage; $V_{th,T2}$ is a threshold voltage of transistor T2; $V_A$ represents a voltage of point $V_A$; and $V_S$ represents a voltage of point $V_S$. Compared with an analog driving mode, the digital driving mode may restrain the problem of non-uniform luminance of the OLED, because the change ΔVth of a transistor threshold voltage Vth is small relative to (VA-VS) due to device degradation or inconsistency.

When the pixel driving circuit as shown in FIG. 1 works, transistor T1 charges for the voltage at point VA, while transistor T3 discharges for the voltage at point VA; eventually, only two Gamma voltage levels are controlled to be output at VA, and gray levels are sliced out in a Pulse-Width Modulation (PWM) way.

FIG. 2 shows a diagram of using PWM driving for subfields of 6 bits, and 1280 scanning lines. Images different in gray level luminance may be displayed using digital voltages (i.e., two Gamma voltages) by controlling the length of subfield (SF) charging time in combination with the principle that human eye perception of luminance is integral of time domain. The subfields are displayed by time in an order of bit 0, bit 1, bit 2, bit 3, bit 4, and bit 5; the weights of the subfields are 1:2:4:8:16:32; oblique line 1 is the course of enabling a pixel charging scanning line; Tch is the time of charging a complete pixel within a subfield; oblique line 2 is the course of enabling a pixel discharging scanning line; and Tdch is the time of discharging a complete pixel within a subfield.

With the 6 subfields different in weight as shown in FIG. 2 for example, if subfields of one frame of image are driven according to weight ratio of 1:2:4:8:16:32, FIG. 3 shows relations between various gray levels and the subfields, wherein circles represent opening of corresponding subfields. When one frame of image is switched to another frame of image and gray levels of pixels are switched from 3 to 4, 7 to 8, 15 to 16, 31 to 32, 32 to 31, etc., wrong dark lines or bright lines will appear in positions where the gray levels of pixels are switched, as shown in FIG. 4, thus leading to an image display error.

SUMMARY OF THE INVENTION

To solve the above problem, the present disclosure provides an OLED PWM pixel driving method for eliminating the problem of gray level display errors in digital driving.

According to one embodiment of the present disclosure, an OLED PWM pixel driving method is provided, which comprises:

slicing a frame of image into a plurality of subfields different in weight, and splitting a subfield having a higher weight thereamong into secondary subfields in a predetermined splitting ratio; and rearranging split secondary subfields from the subfield having a higher weight and non-split subfields according to an input image and the predetermined splitting ratio in order to eliminate an image display error.

According to one embodiment of the present disclosure, rearranging the split secondary subfields from the subfield having a higher weight and the non-split subfields according to the input image and the predetermined splitting ratio further comprises:

placing a subfield having a highest weight amongst the non-split subfields in a middle of the whole frame of image, and separately placing the split secondary subfields from the subfield having a higher weight at two sides of the subfield having the highest weight amongst the non-split subfields.

According to one embodiment of the present disclosure, separately placing the split secondary subfields from the subfield having a higher weight at the two sides of the subfield having the highest weight amongst the non-split subfields further comprises:

separately placing the split secondary subfields from the subfield having a higher weight at the two sides of the subfield having the highest weight amongst the non-split subfields according to weight levels.

According to one embodiment of the present disclosure, a subfield having a highest weight amongst remaining subfields apart from the subfield having the highest weight amongst the non-split subfields is placed at one end of the whole frame of image, and subfields having other weights are placed at another end of the whole frame of image.

According to one embodiment of the present disclosure, relative positions of the subfield having the highest weight and the subfields having other weights amongst the remaining subfields apart from the subfield having the highest weight amongst the non-split subfields are adjusted according to a precedence gray level relation of the whole frame of image.

According to one embodiment of the present disclosure, splitting the subfield having a higher weight thereamong into the secondary subfields in the predetermined splitting ratio further comprises:

splitting, if the weight of the subfield having a higher weight is an even number, the subfield into two secondary subfields of equal weights.

According to one embodiment of the present disclosure, splitting the subfield having a higher weight thereamong into the secondary subfields in the predetermined splitting ratio further comprises:

splitting, if the weight of the subfield having a higher weight is an odd number, the subfield into two secondary subfields by equal weights or adjacent size weights.

According to one embodiment of the present disclosure, one or more subfields having higher weights are present.

According to one embodiment of the present disclosure, when a plurality of subfields having higher weights are present with the weights thereof being even numbers, the split secondary subfields are separately placed at the two sides of the subfield having the highest weight amongst the non-split subfields according to the weight levels, wherein secondary subfields having higher weights are close to the subfield having the highest weight amongst the non-split subfields.

According to one embodiment of the present disclosure, when a plurality of subfields having higher weights are present with the weights thereof being odd numbers and the subfields are split into secondary subfields having adjacent size weights, a split secondary subfield having a higher weight from one subfield thereamong and a split secondary subfield having a lower weight from another subfield are placed at one side of the subfield having the highest weight amongst the non-split subfields, and various split subfields are placed at the two sides of the subfield having the highest weight amongst the non-split subfields according to the weight levels, wherein secondary subfields having higher weights are close to the subfield having the highest weight amongst the non-split subfields.

Advantages of the pressure disclosure are as follows.

According to the present disclosure, the subfields having higher weights are split into the secondary subfields in the predetermined splitting ratios, and the split subfields having higher weights and the non-split subfields are rearranged according to the input image and the predetermined splitting ratios. Thus, the problem of gray level display errors in digital driving may be eliminated.

Other advantages, objectives and features of the present disclosure will be further explained in the following description, and to some extent, become apparent for those skilled in the art based on observational study on the description below, or may be taught from the practice of the present disclosure. The objectives and other advantages of the present disclosure may be achieved through the structure specifically pointed out in the following description, claims, and the accompanying drawings.

BRIEF DESCRIPTION OF THE DRAWINGS

The drawings are provided for further understanding of the technical solution of the present application or the prior art, and constitute one part of the description. Amongst them, the drawings showing the embodiments of the present application serve to explain the technical solution of the present application in conjunction with the embodiments of the present application, rather than to limit the technical solution of the present application. In the drawings.

DETAILED DESCRIPTION OF THE EMBODIMENTS

The implementations of the present disclosure will be explained in detail below in connection with the accompanying drawings and the embodiments, whereby the implementation process of how technical means are applied to solve the technical problem and the corresponding technical effect is achieved in the present disclosure can be fully understood and then implemented. The embodiments of the present application and various features in the embodiments may be combined with one another without conflict, and the resulting technical solutions should all fall into the scope of the present disclosure.

Figure 1:
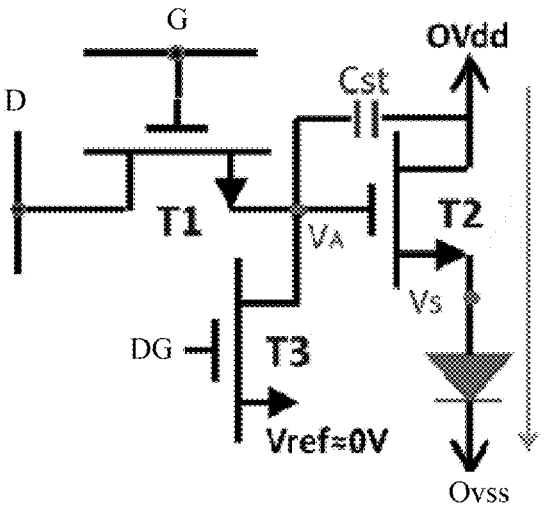
Fig. 1 (Prior Art)
FIG. 1 is a diagram of an OLED 3TIC pixel driving circuit in the prior art.
Figure 2:
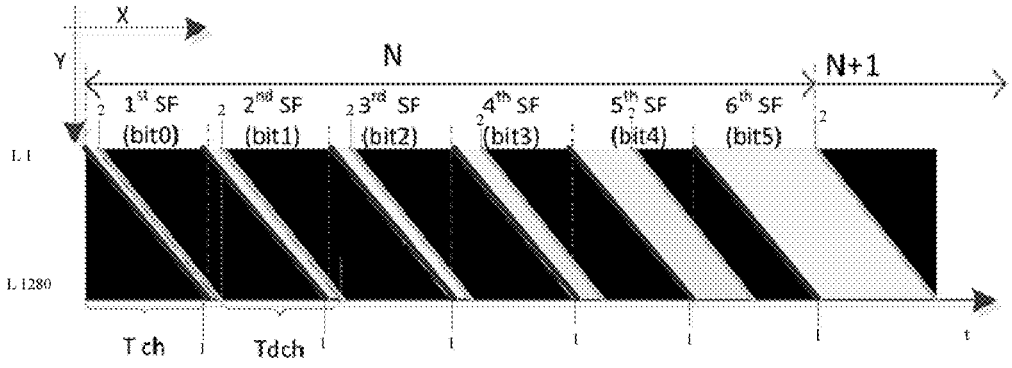
Fig. 2 (Prior Art)
FIG. 2 is a diagram of PWM digital driving for 6 subfields in the circuit in FIG. 1.
Figure 3:
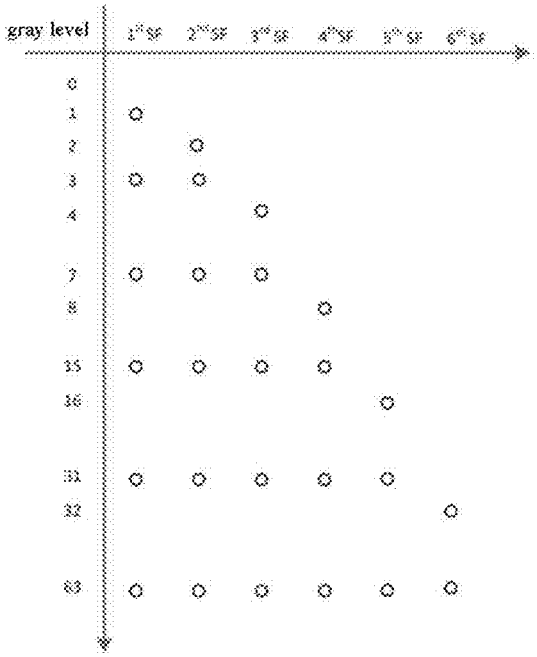
Fig. 3 (Prior Art)
FIG. 3 is a diagram of relations between gray levels and subfields in FIG. 2.
Figure 4:
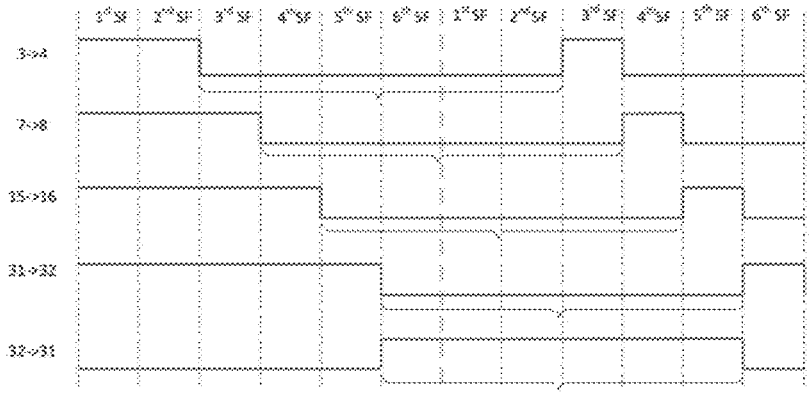
Fig. 4 (Prior Art)
FIG. 4 is a diagram of an error in gray level display of subfields resulting from the relations between gray levels and subfields as shown in FIG. 3.
Figure 5:
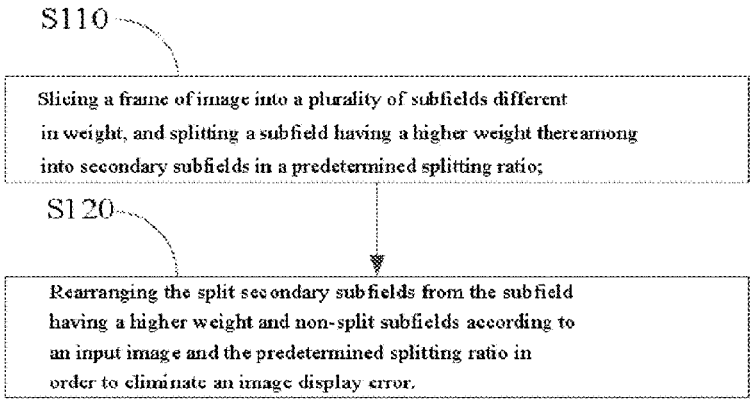
FIG. 5 is a flow chart of an OLED PWM pixel driving method according to one embodiment of the present disclosure.

To solve the problem of dark lines or bright lines in the subfields as shown in FIG. 4, the present disclosure provides an OLED PWM pixel driving method. FIG. 5 is a flow chart of a method according to one embodiment of the present disclosure. The present disclosure will be explained in detail below with reference to FIG. 5.

Specifically, the OLED PWM pixel driving method comprises the following steps. In step S110, a frame of image is sliced into a plurality of subfields different in weight, and a subfield having a higher weight thereamong is split into secondary subfields in a predetermined splitting ratio. In step S120, secondary subfields split from the subfield having a higher weight and non-split subfields are rearranged according to an input image and the predetermined splitting ratio in order to eliminate an image display error. Thus, by splitting the subfield having a higher weight of the original frame of image in the predetermined splitting ratio and rearranging the subfields, dark lines or bright lines appearing during skipping of image pixel gray levels may be eliminated, and the display error is eliminated, thus improving the display effect. It needs to be noted that one or more subfields having higher weights may be present in the present disclosure. The specific number may be set according to display requirements, and specific weight values may also be set according to the display requirements. For example, subfield 5 having a weight of 16 and subfield 6 having a weight of 32 amongst 6 subfields in a weight ratio of 1:2:4:8:16:32 may be set as the subfields having higher weights, and the weight of 1, the weight of 2, the weight of 4 and the weight of 8 may be set as corresponding to subfield 1, subfield 2, subfield 3, and subfield 4, respectively. The present disclosure will be further explained with this example. Alternatively, only subfield 6 having the weight of 32 may be set as the subfield having a higher weight.

In one embodiment of the present disclosure, rearranging the split secondary subfields from the subfield having a higher weight and the non-split subfields according to the input image and the predetermined splitting ratio further comprises: placing a subfield having a highest weight amongst the non-split subfields in a middle of the whole frame of image, and separately placing the split secondary subfields from the subfield having a higher weight at two sides of the subfield having the highest weight amongst the non-split subfields. Specifically, when subfield 5 and subfield 6 are being split, the subfield having the highest weight amongst the non-split subfields is subfield 4 with a corresponding weight of 8. The split secondary subfields from subfield 5 and subfield 6 are separately placed at the two sides of subfield 4.

In one embodiment of the present disclosure, separately placing the split secondary subfields from the subfield having a higher weight at the two sides of the subfield having the highest weight amongst the non-split subfields further comprises: separately placing the split secondary subfields from the subfield having a higher weight at the two sides of the subfield having the highest weight amongst the non-split subfields according to weight levels. Specifically, when the split secondary subfields from the subfield having a higher weight are different in weight, the split subfields from the subfield having a higher weight are separately placed at the two sides of the subfield having the highest weight amongst the non-split subfields in an order of weight levels.

In one embodiment of the present disclosure, a subfield having a highest weight amongst remaining subfields apart from the subfield having the highest weight amongst the non-split subfields is placed at one end of the whole frame of image, and the rest is placed at another end of the whole frame of image. Specifically, the non-split subfields are arranged in the whole frame of image according to the weight levels, wherein the subfield having the highest weight apart from the subfield having the highest weight amongst the non-split subfields is placed at one end of the whole frame of image, and the rest is placed at another end of the whole frame of image. That is, the split secondary subfields from the subfield having a higher weight and the subfield having the highest weight amongst all the non-split subfields are located between the subfield having the highest weight amongst the remaining subfields apart from the subfield having the highest weight amongst the non-split subfields and other non-split subfields.

In one embodiment of the present disclosure, relative positions of the subfield having the highest weight and the subfields having other weights amongst the remaining subfields apart from the subfield having the highest weight amongst the non-split subfields are adjusted according to a precedence gray level relation of the whole frame of image. Specifically, when the 6 subfields are output in the weight ratio of 1:2:4:8:16:32 and in an order of bit 0, bit 1, bit 2, bit 3, bit 4, and bit 5, the subfields corresponding to subfield 1 and subfield 2 having lower weights are placed at a front end, and the subfields having other weights are placed at a rear end.

In one embodiment of the present disclosure, if the weight of a subfield having a higher weight is an even number, the subfield is split into two secondary subfields of equal weights. If the weight of a subfield having a higher weight is an odd number, the subfield is split into two secondary subfields of equal weights or adjacent size weights. Specifically, it can be assumed that subfield 5 having the weight of even number 16 and subfield 6 having the weight of even number 32 may be equally split. The two subfields are split into secondary subfields having equal weights of 8 and 8, and secondary subfields having equal weights of 16 and 16, respectively. However, if the weight is an odd number, for example, when the weights are 5 and 7, the weight of 5 may be split into the weights of 2 and 3, and the weight of 7 may be split into the portions of 3 and 4. Certainly, the weight of 5 may also be split into two portions of 2.5 and 2.5, and the weight of 7 may be split into two portions of 3.5 and 3.5.

Figure 6:
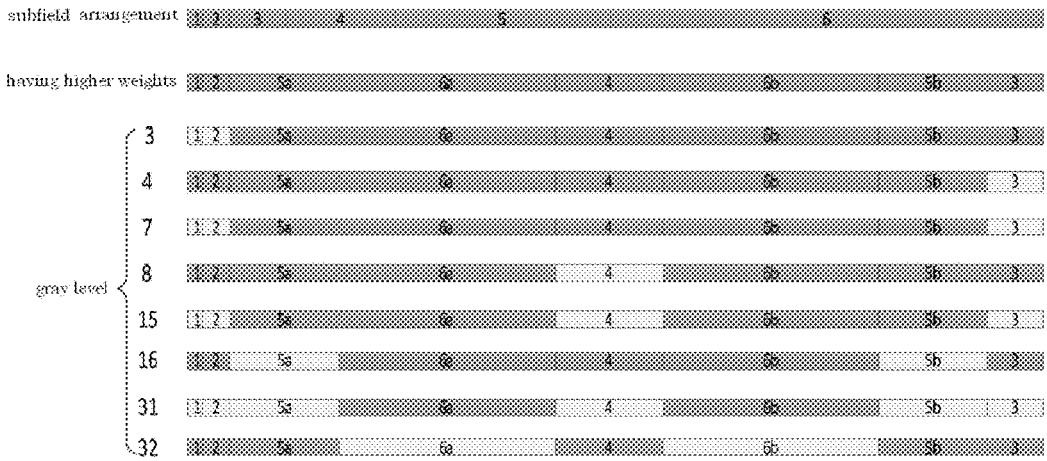
FIG. 6 is a diagram of gray level distribution after weight redistribution of subfields having higher weights according to one embodiment of the present disclosure.

In one embodiment of the present disclosure, when a plurality of subfields having higher weights are present with the weights thereof being even numbers, the split secondary subfields are placed at the two sides of the subfield having the highest weight amongst the non-split subfields according to the weight levels, wherein secondary subfields having higher weights are close to the subfield having the highest weight amongst the non-split subfields. Specifically, the 6 subfields are arranged with a weight ratio of 1:2:8:16:8:16:8:4. As shown in FIG. 6, the subfield 5 having the weight of 16 is split into the secondary subfields having equal weights of 8 and 8, which correspond to 5a and 5b in FIG. 6, and the subfield 6 having the weight of 32 is split into the secondary subfields having equal weights of 16 and 16, which correspond to 6a and 6b in FIG. 6. The weights of 1 and 2 are located at a left side of the frame image, and subfield 3 corresponding to the weight of 4 is placed at a right side of the frame image.

As shown in FIG. 6, the subfields corresponding to filled areas are closed, while the subfields corresponding to unfilled areas are opened. After redistribution of the gray levels, when one frame of image is switched to another frame of image and the gray levels of pixels are switched from 3 to 4, 7 to 8, 15 to 16, 31 to 32, 32 to 31, etc., no obvious wrong dark line or bright line will appear, and corresponding gray levels are displayed normally. The distribution of subfields 1, 2, and 3 in the whole frame of image in FIG. 6 may be adjusted according to progressive increase or progressive decrease of interframe gray levels, so as to achieve a better display effect.

In one embodiment of the present disclosure, when a plurality of subfields having higher weights are present with the weights thereof being odd numbers and the subfields are split into secondary subfields having adjacent size weights, a split secondary subfield having a higher weight from one subfield thereamong and a split secondary subfield having a lower weight from another subfield are placed at one side of the subfield having the highest weight amongst the non-split subfields, and various split subfields are placed at the two sides of the subfield having the highest weight amongst the non-split subfields according to the weight levels, wherein secondary subfields having higher weights are close to the subfield having the highest weight amongst the non-split subfields. For example, for the two subfields having the weights of 5 and 7, the weight of 5 is split into the weights of 2 and 3, and the weight of 7 is split into the portions of 3 and 4; and weight 2 split from the weight of 5, and weight 4 split from the weight of 7 are placed at one and a same side of the subfield having the highest weight, while weight 3 split from the weight of 5, and weight 3 split from the weight of 7 are placed at another side of the subfield having the highest weight.

According to the present disclosure, the subfields having higher weights are split into the secondary subfields in the predetermined splitting ratios, and the split subfields having higher weights and the non-split subfields are rearranged according to the input image and the predetermined splitting ratios. Thus, the problem of gray level display errors in digital driving may be eliminated.

While the embodiments disclosed by the present disclosure are described above, the described contents are merely embodiments used for the sake of convenient understanding of the present disclosure, and may not be intended to limit the present disclosure. Any modifications and variations may be made to the modes and details of the implementations by any person skilled in the technical field to which the present disclosure belongs without departing from the spirit and scope disclosed by the present disclosure. However, the scope of the present disclosure should be subject to the scope defined by the appended claims.

The invention claimed is:

1. An OLED PWM pixel driving method, comprising:

slicing a frame of image into a plurality of subfields different in weight such that the weights of the plurality of subfields are different from each other, and splitting a subfield having a higher weight thereamong into secondary subfields in a predetermined splitting ratio; and rearranging split secondary subfields from the subfield having a higher weight and non-split subfields according to an input image and the predetermined splitting ratio in order to eliminate an image display error;

wherein when a plurality of subfields having higher weights are present with the weights thereof being odd numbers and the subfields are split into secondary subfields having adjacent size weights, a split secondary subfield having a higher weight from one subfield there among and a split secondary subfield having a lower weight from another subfield are placed at one side of the subfield having the highest weight amongst the non-split subfields, and various split subfields are placed at the two sides of the subfield having the highest weight amongst the non-split subfields according to the weight levels, and wherein secondary subfields having higher weights are close to the subfield having the highest weight amongst the non-split subfields; and wherein a subfield having a highest weight amongst the non-split subfields is placed at a middle of a whole frame of image and a subfield having a highest weight amongst remaining subfields apart from the subfield having the highest weight amongst the non-split subfields is placed at one end of the whole frame of image, and subfields having other weights that are different from each other are placed at another end of the whole frame of image and wherein the plurality of subfields which are of different weights are different from the secondary subfields comprising the single subfield of the plurality of subfields having the highest weight split into two equal weighted values.

2. The method according to claim 1, wherein relative positions of the subfield having the highest weight and the subfields having other weights amongst the remaining subfields apart from the subfield having the highest weight amongst the non-split subfields are adjusted according to a precedence gray level relation of the whole frame of image.

* * * * *